United States Patent [19]

Hayashi et al.

[11] Patent Number: 4,748,000

[45] Date of Patent: May 31, 1988

[54] SOFT MAGNETIC THIN FILM

[75] Inventors: Kazuhiko Hayashi; Masatoshi Hayakawa; Yoshitaka Ochiai; Hideki Matsuda; Wataru Ishikawa; You Iwasaki; Kouichi Aso, all of Kanagawa, Japan

[73] Assignee: Sony Corporation, Tokyo, Japan

[21] Appl. No.: 850,108

[22] Filed: Apr. 10, 1986

[30] Foreign Application Priority Data

Apr. 11, 1985 [JP] Japan ..... 60-77338
Oct. 1, 1985 [JP] Japan ..... 60-218737
Oct. 31, 1985 [JP] Japan ..... 60-244624

[51] Int. Cl.[4] ..... C22C 38/00

[52] U.S. Cl. ..... 420/82; 420/117; 420/104; 148/307; 148/311

[58] Field of Search ..... 148/307, 308, 311; 420/8, 104, 117, 82

[56] References Cited

U.S. PATENT DOCUMENTS 3,650,851 3/1972 Stefan et al. ..... 148/307
4,581,080 4/1986 Meguro et al. ..... 148/307

FOREIGN PATENT DOCUMENTS 55-73847 6/1980 Japan ..... 148/307

*Primary Examiner*—John P. Sheehan
*Attorney, Agent, or Firm*—Hill, Van Santen, Steadman & Simpson

[57] ABSTRACT

Disclosed is a soft magnetic thin film which has superior soft magnetic characteristics and high saturation magnetic flux density. The magnetic thin film is formed by physical vapor deposition process and composed of Fe, Ga, and Si with optional inclusion of Co, Ru, or Cr.

6 Claims, 4 Drawing Sheets

SOFT MAGNETIC THIN FILM

BACKGROUND OF THE INVENTION

The present invention relates to a soft magnetic thin film and more particularly to a soft magnetic thin film having high saturation magnetic flux density and suitable for a magnetic transducer head.

In magnetic recording apparatus such as, for example, video tape recorders (VTRs), researches are being made towards increasing the recording density and the frequency of the recording signals. In keeping pace with the tendency towards high density recording, so-called metal powder tapes making use of the powders of the ferromagnetic metals, such as Fe, Co or Ni, as magnetic powders, or so-called evaporated metal tapes in which the ferromagnetic metal material is deposited on the base film, are also used as the magnetic recording medium. By reason of the high coercive force Hc of said magnetic recording medium, head materials of the magnetic head for both recording and replaying are required to have a high saturation magnetic flux density Bs and high permeability $\mu$. For instance, the ferrite material used frequently is low in saturation magnetic flux density Bs, whereas permalloy presents a problem in abrasion resistance.

Fe-Al-Si alloys, so-called sendust alloys are practically used to satisfy such requirement.

In the sendust alloy, it is preferable to have magnetostriction $\lambda s$ and crystalline magnetic anisotropy K both about zero. The composition of the sendust alloy for use in a magnetic transducer head is determined by considering the magnetostriction and the crystalline magnetic anisotropy. Thus the saturation magnetic flux density is uniquely determined by the composition. In sendust alloy, the saturation magnetic flux density is about 10000 to 11000 gauss at most, considering the soft magnetic property for use in magnetic transducer head.

Amorphous magnetic alloys are known which have a wide permeability at high frequency band and high saturation magnetic flux density.

The amorphous magnetic alloy has the saturation magnetic flux density of 12000 gauss at most when considering the soft magnetic property. The amorphous magnetic alloy is not stable upon heat treatment, and changed into crystalline phase by heat treatment at, for example, 500° C. which results in the loss of the magnetic characteristics that the amorphous phase had. In manufacturing manetic transducer heads, various heat treatments are employed, for example, melt bonding of cores by glass at an elevated temperature. However in using amorphous magnetic mateiral, there are some restrictions on temperature in the manufacturing process. Thus the prior art magnetic materials for magnetic transducer head core are still not satisfactory in saturation magnetic flux density to fully use the capability of a high coercive force magnetic recording medium for high density recording.

OBJECT AND SUMMARY OF THE INVENTION

Accordingly, it is an object of the present invention to provide an improved soft magnetic thin film having high saturation magnetic flux density.

It is another object of the present invention to provide a soft magnetic thin film having high saturation magnetic flux density and improved corrosion resistance.

According to one aspect of the present invention there is provided a soft magnetic thin film which has a composition represented by the formula $Fe_aGa_bSi_c$, wherein a, b, and c, each repreents atomic percent of the respective elements and satisfies the relations of $$68 \leqq a \leqq 84$$

$$1 \leqq b \leqq 23$$

$$9 \leqq c \leqq 31$$

$$a+b+c=100.$$

In a further aspect of the invention, part of the iron may be substituted by cobalt, with an amount of not more than 15 atomic percent of the total alloy composition. Ru may be contained in the alloy composition in an amount from 0.1 to 10 atomic percent to improve the abrasion resistance of the soft magnetic thin film.

DESCRIPTION OF THE PREFERRED EMBODIMENTS

On the course of the research to realize the object, the present inventors arrived at the following recognition.

(1) To obtain soft magnetic material having saturation magnetic flux density Bs larger than Bs of the sendust alloy, it is necessary that the compositional area on the ternary diagram of Fe alloy which satisfies the condition that magnetostriction $\lambda s$ and crystalline magnetic anisotropy both equal to zero exists more on the Fe rich side than the compositional area of $\lambda s$ and K both equal to zero for the sendust alloy.

(2) Considering the contribution of the element to the magnetization, among 100 Fe atoms, when one Fe atom is replaced by one Al atom, decreased amount of magnetic moment is 2.66 $\mu_B$, when one Fe atom is replaced by one Si atom, the decreased amount of magnetic moment is 2.29 $\mu_B$, when one Fe atom is replaced by one Ga atom, the decreased amount of magnetic moment is 1.43 $\mu_B$, and when one Fe atom is replaced by one Ge atom, the decreased amount of magnetic moment is 1.36 $\mu_B$ at 0° K. It is understood that there is a posibility to obtain larger Bs material by combining such elements.

(3) Inclusion of Co is effective to obtain large Bs, and corrosion resistance and abrasion resistance.

Then, in the present invention Fe-Ga-Si alloys and Fe-Co-Ga-Si alloys are considered.

Figure 1A:
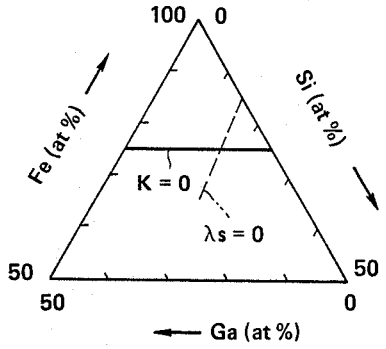
FIGS. 1A, 1B, and 1C are ternary diagram showings the magnetostriction lambda ($\lambda$) s and crystalline magnetic anisotropy K of the ternary Fe alloys.

In FIG. 1A, the dotted line indicates the composition where the magnetostriction λs equals to 0, while the solid line indicates the composition where crystalline magnetic anisotropy K equals to zero in case of Fe-Ga-Si ternary system alloy. Superior soft magnetic characteristics can be obtained around the area where the solid line and the dotted line cross with each other.

Figure 1B:
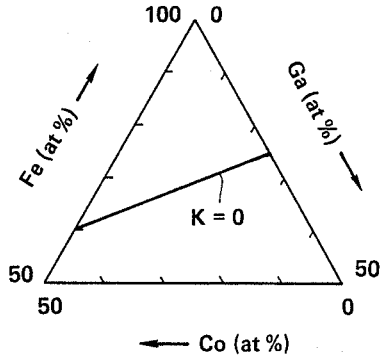
Figure 1C:
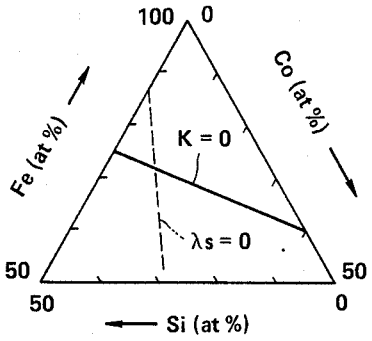

FIGS. 1B, and 1C shows λs equals to zero line and K equals to zero line for Fe-Co-Ga ternary system alloy, and Fe-Co-Si ternary system alloy respectively. In case of Fe-Co-Ga-Si system alloy, considering the 3 dimensional phase diagram, a plane representing K=0, and a plane representing λs=0 exists at Fe rich side, and soft magnetic characteristics can be obtained around the cross line of the planes.

From another point of view that Co is added to Fe-Ga-Si ternary alloy, saturation magnetic flux density, corrosion resistance, and abrasion resistance are improved by addition of Co, however, too much addition of Co, results in reduced Bs, and deteriorated soft magnetic characteristics.

Figure 2:
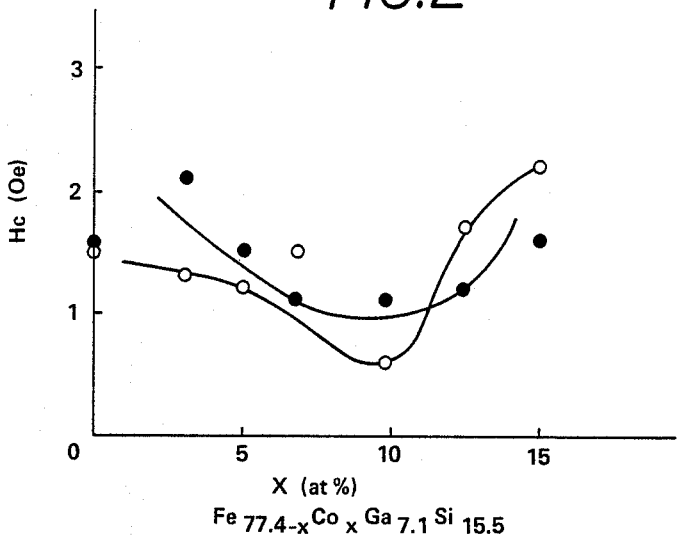
FIG. 2 is a graph showing the relationship of Co content and coercive force of the alloy of the present invention.

FIG. 2 shows the relationship between amount of cobalt and coercive force after annealing at 500° C. and 550° C. for the composition $Fe_{77.4-x}Co_xGa_{7.1}Si_{15.5}$. In FIG. 2, ○ indicates the result after annealing at 500° C. and ● indicates the result after annealing at 550° C.

It is understood from FIG. 2, that coercive force Hc shows the minimum value for 10 atomic percent of Co. Thus there is a desirable range of addition of Co.

According to the experiments conducted by the present inventors, soft magnetic material having higher saturation magnetic flux density Bs than that of the sendust alloy and soft magnetic characteristics comparable to that of sendust alloy is obtained in case of $Fe_aGa_bSi_c$ ternary system alloy when the composition satisfies the following relations in atomic percent $$68 \leqq a \leqq 84$$

$$1 \leqq b \leqq 23$$

$$9 \leqq c \leqq 31$$

$$a+b+c=100.$$

In case of $Fe_aCo_bGa_cSi_d$ system alloy, suitable soft magnetic thin film having high saturation magnetic flux density is obtained when the composition of the alloy satisfies the relations $$68 \leqq a+b \leqq 84$$

$$0 \leqq b \leqq 15$$

$$1 \leqq c \leqq 23$$

$$9 \leqq d \leqq 31$$

$$a+b+c+d=100$$

Figure 6:
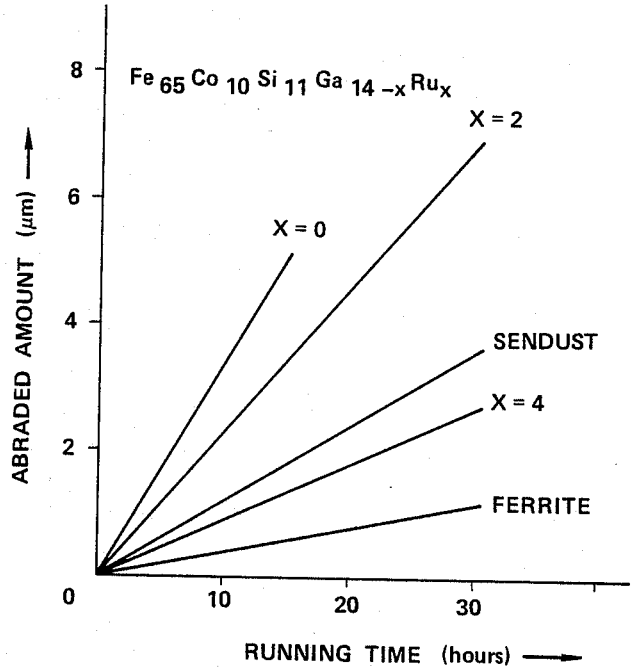
FIG. 6 is a graph showing the abrasion resistance characteristics of various alloys.

According to our further investigation, it is effective to replace part of the composition by Ru to improve the corrosion resistance and abrasion resistance characteristics of the soft magnetic thin film. FIG. 6 shows the abraded amount of a magnetic transducer head made by various soft magnetic material of $Fe_{65}Co_{10}Si_{11}Ga_{14-x}Ru_x$ (x=0, x=2, x=4), sendust alloy and ferrite, upon running test with magnetic recording tape in which the abscissa represents running time in hours and the ordinate represents abraded amount of the head in μm. By replacement with Ru, abraded amound decreases, and is smaller than that of the sendust alloy. While, replacement of Fe with Ru results in decreased saturation magnetic flux density, however the decreased amount is smaller than decrease of Bs when replaced by Cr, Ga or Si. Thus in our invention Ru may be present in the composition in the range between 0.1 and 10 atomic percent. When the amount is less than 0.1 atomic percent no improvement in abrasion resistance is expected and when the amount is more than 10 atomic percent, saturation magnetic flux density decreases and soft magnetic characteristics are deteriorated. When the amount of Fe and/or Co is out of the range, high saturation magnetic flux density can't be obtained, and when the amounts of Ga and Si are out of the range, soft magnetic characteristics can't be obtained.

The soft magnetic thin film of the present invention may have a thickness of not less than 0.5 μm and not more than 100 μm.

Figure 7:
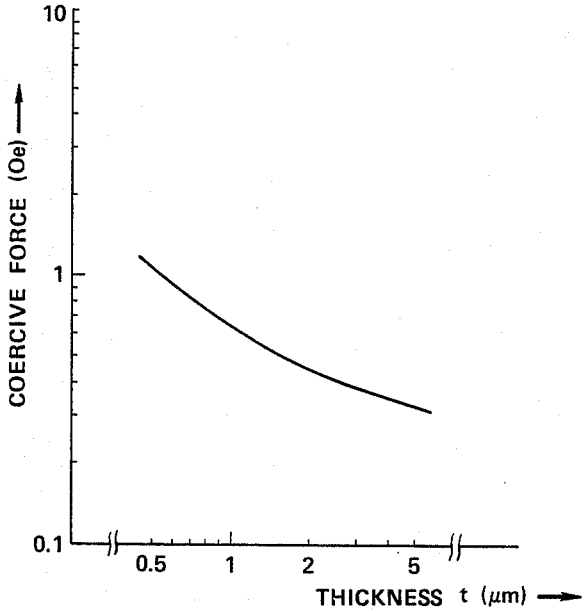
FIGS. 7 and 8 are graphs showing thickness dependency of coercive force and permeability respectively.
Figure 8:
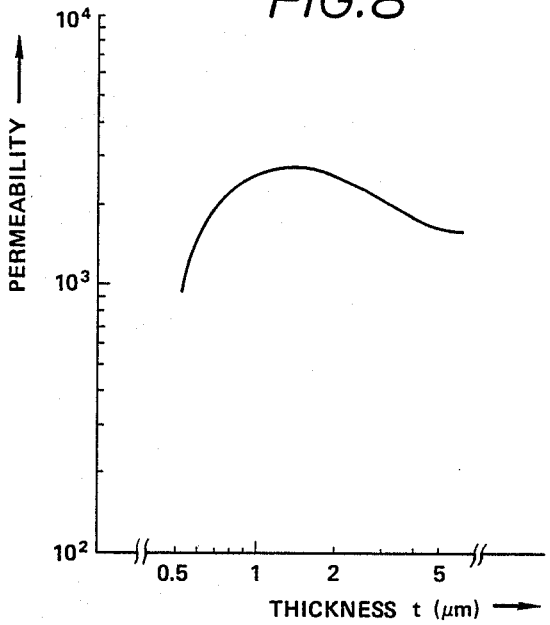

FIGS. 7 and 8 show thickness dependency of the coercive force and permeability at 1 MHz measured on a film sample having composition $Fe_{73}Ru_4Ga_{10}Si_{13}$ after annealing at 450° C. respectively. When the thickness is less than 0.5 μm, soft magnetic characteristics are deteriorated, while thickness exceeding 100 μm is difficult to obtain by physical vapor deposition process without inducing internal stress.

The soft magnetic thin film may be manufactured by physical vapor deposition process, such as sputtering, ion plating, vacuum evaporation, or cluster ion beam deposition.

When adjusting the ratio values of the respective elements of the magnetic thin film, such as Fe, Ga or Si, the following methods may be employed.

(i) Fe, Ga, Si, other additives and replacement metals are weighed so that a preset relative composition is satisfied. The respective components are previously melted in e.g. an induction furnace for forming an alloy ingot which may be used as deposition source.

(ii) The deposition sources for the respective elements are prepared and the composition is controlled by activating the selected number of the deposition sources.

(iii) The respective deposition sources of the component elements are provided and the input applied to these respective sources (impressed voltage) is adjusted for controlling the deposition speed and hence the film composition.

(iv) The alloy is used as the deposition source and other elements are implanted during deposition.

EXAMPLE 1

Fe, Ga, and Si are respectively weighed to make a predetermined composition. These materials were melted in RF induction heating furnace. The melt was cast and machined to make an alloy target for sputtering of 4 inches in diameter and 4 mm thickness. Films were deposited on crystalline glass substrate (HOYA PEG 3130C, made by Hoya Glass Company) by using the sputtering target thus made in a RF magnetron sputtering apparatus. The sputtering was carried out under the condition of RF input of 300 W and Ar pressure of $5\times10^{-3}$ Torr to obtain films having 1 μm thickness. The obtained thin films were further annealed at 500° C. under vacuum of less than $1\times10^{-6}$ Torr for 1 hour and cooled.

By selecting the composition as shown in Table I, films of samples No. 1 through 14 were made. The target composition and the deposited film composition are different by a little amount. The samples obtained were subjected to measurement of magnetic characteristics of saturation magnetic flux density Bs, coercive force Hc, saturation magnetization $\sigma s$, permeability $\mu$ at 1 MHz and 100 MHz, magnetostriction, and anti-corrosion characteristics. The saturation magnetic flux density was measured by a vibrating sample magnetometer (VSM), coervice force was measured by a B-H loop tracer, permeability was measured by permeance metal using figure 8 coil. The thickness of the samples was determined by using multiple beam interferometer.

The film composition was determined by EPMA. The anticorrosion characteristics were examined according to the following standard by observing the appearance of the film surface after one week immersion of the film in water at room temperature.

A: no change was observed and showing the original mirrow surface.

B: rust is lightly observed

C: rust is heavily observed

D: most of the film disappeared due to the rust

The obtained results are shown in Table I. In Table I, for comparison, Fe-Si alloy (electromagnetic steel) and Fe-Al-Si alloy (sendust) were also prepared according to the method described above.

tension and compression to the film. The magnetostriction was less than $1\times10^{-6}$ for each of the film samples of the present invention.

Figure 3:
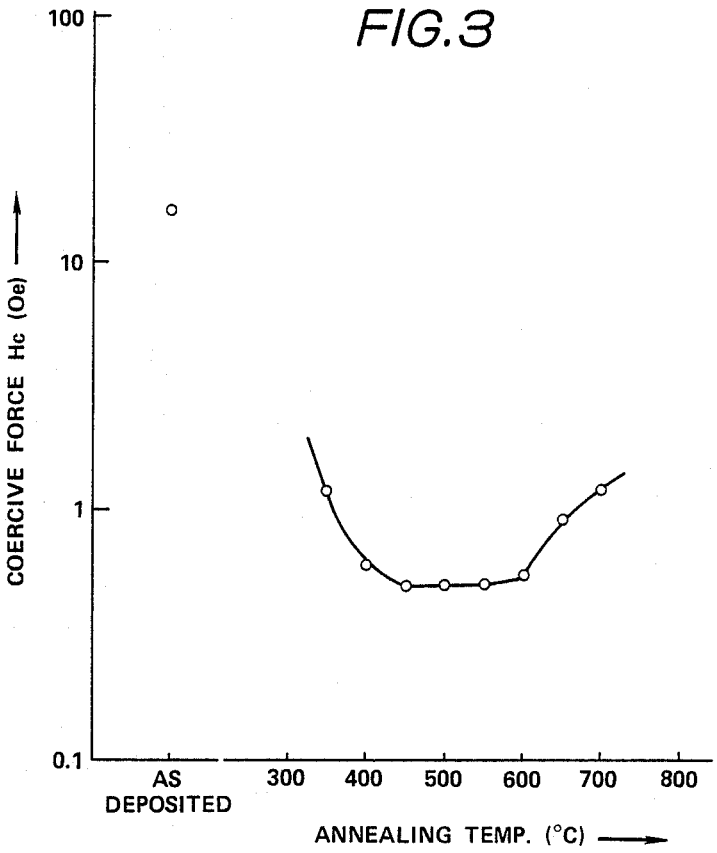
FIG. 3 is a graph showing annealing temperature dependency of coercive force.

In this example, the films deposited were subjected to an annealing treatment at 500° C. The sample No. 1 having a film composition of $Fe_{78.2}Ga_{7.2}Si_{14.6}$ had the coercive force of about 16 Oe, when measured on the film as deposited. We considered the relation between the annealing temperature and the coercive force of the films. The experimental results are shown in FIG. 3 which indicate that the coercive force is greatly reduced by annealing the deposited film at the elevated temperature, and the coervice force shows the minimum value by annealing at a temperature between 450 and 650° C.

Figure 4:
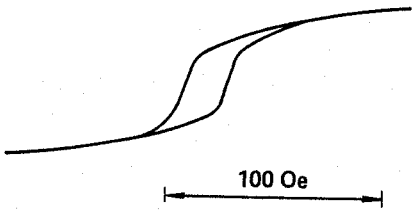
FIGS. 4 and 5 are B-H hysterisis loops for explaining the present invention.
Figure 5:
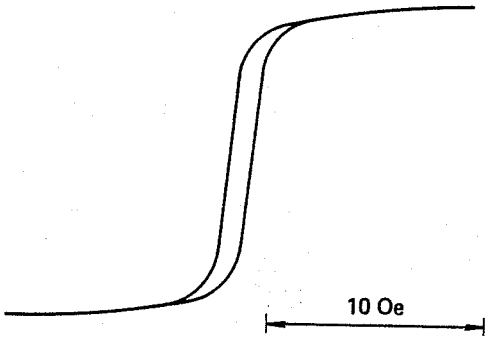

FIG. 4 is a B-H hysteresis loop of as deposited film sample 2 having the film composition of $Fe_{77.1}Ga_{9.0}Si_{13.9}$ while FIG. 5 shows a B-H loop for the same film sample which was subjected to the annealing treatment at 500° C. for 1 hour. Comparing these 2 B-H loops, it is understood that the soft magnetic characteristics of the magnetic thin film of the present invention are greatly improved.

EXAMPLE 2

Targets containing Fe, Co, Ga and Si were prepared. Film samples No. 21 through 29 were deposited by the method explained in example 1. The deposited film

TABLE I

| | Target Composition (atomic percent) | Deposited Film Composition (atomic percent) | Bs (K Gauss) | $\sigma g$ (emu/g) | Hc (0 e) | $\mu$ 1 MHz | $\mu$ 100 MHz | magneto-striction | anti-corrosion |
|---|---|---|---|---|---|---|---|---|---|
| Comparative Sample 1 (electromagnetic steel) | $Fe_{85.5}Si_{14.5}$ | $Fe_{87.5}Si_{12.5}$ | 17.6 | 187 | 2.5 | 400 | 150 | ~0 | D |
| Comparative Sample 2 (Sendust) | $Fe_{74}Si_{18}Al_{8}$ | $Fe_{74.5}Si_{17.9}Al_{7.6}$ | 10.3 | 110 | 0.5 | 1500 | 800 | ~0 | A |
| Sample 1 | $Fe_{75}Ga_{10}Si_{15}$ | $Fe_{78.2}Ga_{7.2}Si_{14.6}$ | 13.1 | 139 | 0.5 | 2000 | 1700 | + | A |
| Sample 2 | $Fe_{74}Ga_{12}Si_{14}$ | $Fe_{77.1}Ga_{9.0}Si_{13.9}$ | 12.6 | 134 | 0.5 | 2200 | 1800 | + | A |
| Sample 3 | $Fe_{78}Ga_{6}Si_{16}$ | $Fe_{80.8}Ga_{3.7}Si_{15.5}$ | 14.2 | 151 | 0.8 | 1400 | 900 | ~0 | A |
| Sample 4 | $Fe_{74}Ga_{11}Si_{15}$ | $Fe_{78.1}Ga_{7.9}Si_{14.0}$ | 13.1 | 139 | 0.8 | 1200 | 1000 | + | A |
| Sample 5 | $Fe_{75}Ga_{11}Si_{14}$ | $Fe_{77.0}Ga_{8.1}Si_{14.9}$ | 12.4 | 132 | 0.6 | 1900 | 1100 | + | A |
| Sample 6 | $Fe_{77}Ga_{6}Si_{17}$ | $Fe_{80.5}Ga_{4.0}Si_{15.5}$ | 14.1 | 150 | 0.9 | 1100 | 600 | − | A |
| Sample 7 | $Fe_{76}Ga_{6}Si_{18}$ | $Fe_{79.6}Ga_{3.7}Si_{16.7}$ | 13.5 | 143 | 0.7 | 1300 | 700 | − | A |
| Sample 8 | $Fe_{75}Ga_{8}Si_{17}$ | $Fe_{78.2}Ga_{6.1}Si_{15.7}$ | 12.9 | 137 | 0.7 | 1400 | 600 | ~0 | A |
| Sample 9 | $Fe_{74}Ga_{8}Si_{18}$ | $Fe_{76.2}Ga_{5.9}Si_{17.9}$ | 11.7 | 124 | 0.9 | 1000 | 850 | + | A |
| Sample 10 | $Fe_{76}Ga_{9}Si_{15}$ | $Fe_{79.3}Ga_{5.9}Si_{14.8}$ | 13.6 | 144 | 0.7 | 1300 | 1000 | + | A |
| Sample 11 | $Fe_{73}Ga_{9}Si_{18}$ | $Fe_{75.9}Ga_{5.8}Si_{18.3}$ | 11.5 | 122 | 0.8 | 1200 | 900 | ~0 | A |
| Sample 12 | $Fe_{79}Ga_{3}Si_{18}$ | $Fe_{81.7}Ga_{2.4}Si_{15.9}$ | 14.6 | 155 | 0.8 | 1300 | 850 | − | B |
| Sample 13 | $Fe_{78}Ga_{5.5}Si_{16.5}$ | $Fe_{80.6}Ga_{4.0}Si_{15.4}$ | 14.2 | 150 | 0.8 | 1250 | 900 | ~0 | A |
| Sample 14 | $Fe_{77}Ga_{6.5}Si_{16.5}$ | $Fe_{81.0}Ga_{4.3}Si_{14.7}$ | 14.4 | 153 | 0.9 | 1150 | 850 | ~0 | B |

It is understood from the table, the samples according to the present invention have much larger saturation magnetic flux density, and nearly equivalent soft magnetic property as compared with the sendust alloy film. The films of the present invention are by far superior in soft magnetic property than the Fe-Si alloy film even though they have nearly equivalent magnetic flux density to the Fe-Si film. The magnetostriction was estimated by the anisotropy field value upon application of were subjected to annealing at an elevated temperature between 450° C. and 650° C. in vacuum of less than $1\times10^{-6}$ Torr for 1 hour. The target composition, film composition, various characteristics are shown in Table II. The optimum annealing temperature depends on the film composition, through by annealing between 450° C. and 650° C. soft magnetic characteristics were greatly improved.

TABLE II

| | Target Composition (atomic percent) | Deposited Film Composition (atomic percent) | Ta (°C.) | Bs (K Gauss) | Hc (0 e) | $\mu$ 1 MHz | $\mu$ 100 MHz | magnetostriction | anti-corrosion |
|---|---|---|---|---|---|---|---|---|---|
| Sample 21 | $Fe_{62}Co_{10}Ga_{17}Si_{11}$ | $Fe_{3.8}Co_{10.0}Ga_{14.3}Si_{11.9}$ | 450 | 12.0 | 0.4 | 2300 | 1100 | + | A |
| Sample 22 | $Fe_{70}Co_{5}Ga_{10}Si_{15}$ | $Fe_{72.2}Co_{4.9}Ga_{7.6}Si_{15.3}$ | 500 | 12.9 | 1.2 | 800 | 400 | ~0 | B |
| Sample 23 | $Fe_{65}Co_{10}Ga_{10}Si_{15}$ | $Fe_{67.4}Co_{9.8}Ga_{7.3}Si_{15.5}$ | 500 | 13.0 | 0.7 | 1300 | 700 | − | A |
| Sample 24 | $Fe_{61}Co_{15}Ga_{8}Si_{16}$ | $Fe_{63.7}Co_{15.3}Ga_{4.7}Si_{16.3}$ | 500 | 13.9 | 0.7 | 1100 | 600 | − | A |
| Sample 25 | $Fe_{65}Co_{10}Ga_{11}Si_{14}$ | $Fe_{67.1}Co_{9.8}Ga_{8.4}Si_{14.7}$ | 550 | 13.0 | 0.8 | 1400 | 900 | ~0 | A |
| Sample 26 | $Fe_{70}Co_{5}Ga_{11}Si_{14}$ | $Fe_{72.1}Co_{5.0}Ga_{8.4}Si_{14.5}$ | 600 | 14.3 | 0.9 | 900 | 700 | + | B |
| Sample 27 | $Fe_{63}Co_{10}Ga_{13}Si_{14}$ | $Fe_{64.6}Co_{9.9}Ga_{9.6}Si_{15.9}$ | 500 | 11.8 | 0.9 | 850 | 400 | − | A |
| Sample 28 | $Fe_{70}Co_{5}Ga_{12}Si_{13}$ | $Fe_{75.5}Co_{5.3}Ga_{5.1}Si_{14.1}$ | 550 | 14.7 | 1.0 | 1100 | 600 | + | A |

TABLE II-continued

| | Target Composition (atomic percent) | Deposited Film Composition (atomic percent) | Ta (°C.) | Bs (K Gauss) | Hc (0 e) | μ 1 MHz | μ 100 MHz | magnetostriction | anti-corrosion |
|---|---|---|---|---|---|---|---|---|---|
| Sample 29 | $Fe_{72}Co_3Ga_{10}Si_{15}$ | $Fe_{73.4}Co_{3.0}Ga_{7.4}Si_{16.2}$ | 500 | 12.4 | 1.3 | 1100 | 400 | + | B |

EXAMPLE 3

Sputtering targets containing Fe, Ru, Co, Ga and Si were prepared. Film samples No. 31 through 37 were deposited by the method described in example 1. The deposited films were subjected to annealing treatment at a temperature between 450° C. and 650° C. The target composition, film composition and various characteristics are shown in Table III.

TABLE III

| | Target Composition (atomic percent) | Deposited Film Composition (atomic percent) | Bs (KG) | μ 1 MHz | Hc (0 e) | magneto-striction | Ta (°C.) | abraded amount (μm) | anticorrosion |
|---|---|---|---|---|---|---|---|---|---|
| Sample 31 | $Fe_{70}Ru_4Ga_{12}Si_{14}$ | $Fe_{71.2}Ru_{4.0}Ga_{7.9}Si_{16.9}$ | 11.1 | 3500 | 0.15 | + | 1100 | 4.0 | A |
| Sample 32 | $Fe_{70}Ru_4Ga_{14}Si_{12}$ | $Fe_{72.9}Ru_{4.9}Ga_{10.6}Si_{12.6}$ | 12.3 | 1050 | 1.0 | + | 400 | 4.2 | A |
| Sample 33 | $Fe_{70}Ru_4Ga_{10}Si_{16}$ | $Fe_{71.7}Ru_{4.0}Ga_{7.5}Si_{16.8}$ | 11.3 | 970 | 0.7 | − | 700 | 3.9 | A |
| Sample 34 | $Fe_{72}Ru_4Ga_{12}Si_{12}$ | $Fe_{74.4}Ru_{4.1}Ga_{9.0}Si_{12.5}$ | 11.3 | 2700 | 0.3 | ~0 | 600 | 3.5 | A |
| Sample 35 | $Fe_{58}Co_{10}Ru_4Ga_{17}Si_{11}$ | $Fe_{59.5}Co_{10.6}Ru_{4.5}Ga_{11.2}Si_{14.2}$ | 13.0 | 1200 | 0.7 | + | 900 | 4.3 | A |
| Sample 36 | $Fe_{60}Co_{10}Ru_4Ga_{16}Si_{10}$ | $Fe_{63.2}Co_{10.2}Ru_{4.0}Ga_{12.1}Si_{10.5}$ | 13.1 | 1250 | 0.7 | + | 700 | 3.8 | A |
| Sample 37 | $Fe_{62}Co_{10}Ru_2Ga_{15}Si_{11}$ | $Fe_{65.3}Co_{9.9}Ru_{1.9}Ga_{11.3}Si_{11.6}$ | 13.2 | 2900 | 0.2 | + | 400 | 3.6 | A~B |

What is claimed is:

1. A soft magnetic thin film having a composition represented by the formula:

$$Fe_aGa_bSi_cCo_dRu_eCr_f$$

wherein a, b, c, d, e, and f represent atomic percents and the following relationships apply:

$$68 \leqq a \leqq 84$$
$$2.4 \leqq b \leqq 23$$
$$9 \leqq c \leqq 31$$
$$0 \leqq d \leqq 15$$
$$0 \leqq e \leqq 10$$
$$0 \leqq f \leqq 7$$
$$a+b+c+d+e+f=100.$$

2. A soft magnetic thin film according to claim 1 having a composition represented by the following formula;

$$Fe_aGa_bSi_c$$

wherein a, b, and c each represents atomic percent of the respective elements and satisfies the following relations of $$68 \leqq a \leqq 84$$
$$2.4 \leqq b \leqq 23$$
$$9 \leqq c \leqq 31$$
$$a+b+c=100.$$

3. A soft magnetic thin film according to claim 1 having a composition represented by the following formula;

$$Fe_aCo_bGa_cSi_d$$

wherein a, b, c, and d each represents atomic percent of the respective elements and satisfies the following relations of $$68 \leqq a+b \leqq 84$$
$$0 \leqq b \leqq 15$$
$$2.4 \leqq c \leqq 23$$
$$9 \leqq d \leqq 31$$
$$a+b+c+d=100.$$

4. A soft magnetic thin film according to claim 1, part of Fe, Ga, or Si is replaced by Ru with an amount ranging between 0.1 and 10 atomic percent.

5. A soft magnetic thin film according to claim 1, said thin film further includes between 0.5 and 7 atomic percent Cr.

6. A soft magnetic thin film according to claim 1, wherein said composition evidences a magnetrostriction and a crystalline magnetic anisotropy both substantially equal to zero.

* * * * *